US007486163B2

(12) United States Patent
Nielson et al.

(10) Patent No.: US 7,486,163 B2
(45) Date of Patent: Feb. 3, 2009

(54) LOW-VOLTAGE MICRO-SWITCH ACTUATION TECHNIQUE

(75) Inventors: Gregory N. Nielson, Albuquerque, NM (US); George Barbastathis, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 654 days.

(21) Appl. No.: 10/979,350

(22) Filed: Nov. 2, 2004

(65) Prior Publication Data

US 2005/0173234 A1 Aug. 11, 2005

Related U.S. Application Data

(60) Provisional application No. 60/533,127, filed on Dec. 30, 2003.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,096,279 | A | 3/1992 | Hornbeck et al. | |
| 5,523,633 | A | 6/1996 | Imaizumi et al. | |
| 5,794,761 | A | 8/1998 | Renaud et al. | |
| 6,140,737 | A * | 10/2000 | Boie | 361/235 |
| 6,218,911 | B1 | 4/2001 | Kong et al. | |
| 6,263,736 | B1 * | 7/2001 | Thundat et al. | 361/280 |
| 6,720,851 | B2 * | 4/2004 | Hallbjomer et al. | 335/78 |
| 6,897,537 | B2 | 5/2005 | de los Santos | |
| 7,250,837 | B2 | 7/2007 | Nielson et al. | |
| 7,288,873 | B2 * | 10/2007 | Salsman et al. | 310/322 |
| 2003/0006868 | A1 | 1/2003 | Aigner et al. | |
| 2003/0090346 | A1 | 5/2003 | Nikitin | |
| 2003/0155995 | A1 | 8/2003 | Iwata et al. | |
| 2003/0178913 | A1 | 9/2003 | Norimatsu | |
| 2003/0218283 | A1 | 11/2003 | Yasumura et al. | |
| 2005/0006738 | A1 | 1/2005 | Schaper et al. | |

FOREIGN PATENT DOCUMENTS

| | | |
|---|---|---|
| EP | 1146532 | 10/2001 |
| EP | 1257149 | 11/2002 |
| WO | WO 01/80266 | 10/2001 |
| WO | WO-02/23606 | 3/2002 |
| WO | WO-02/058089 | 7/2002 |

(Continued)

OTHER PUBLICATIONS

International Search Report and Written Opinion for PCT/US2004/036359, Nov. 11, 2004, 8 pages.

(Continued)

*Primary Examiner*—Elvin G Enad
*Assistant Examiner*—Bernard Rojas
(74) *Attorney, Agent, or Firm*—Goodwin Procter LLP

(57) ABSTRACT

An electro-mechanical switch structure includes at least one fixed electrode and a free electrode which is movable in the structure with a voltage potential applied between each fixed electrode and the free, movable electrode. The voltage potentials applied between each fixed electrode and the movable electrode are modulated to actuate the electro-mechanical switch structure.

20 Claims, 6 Drawing Sheets

FOREIGN PATENT DOCUMENTS

WO WO 03/083886 A 9/2003

OTHER PUBLICATIONS

"Parallel-plate MEMS Mirror Design for Large On-Resonance Displacement," Bhalotra et al., *IEEE* (Aug. 2000).
Peroulis et al., "Electromechanical Considerations in developing Low-Voltage RF MEMS Switches," IEEE Transactions on Microwave Theory and Techniques, vol. 51, n. 1 (Jan. 2003).
Robert et al., "Integrated RF-MEMS Switch Based on a Combination of Thermal and Electrostatic Actuation," Int'l. Conference on Solid State Sensors, Actuators and Microsystems, Boston (Jun. 8-12, 2003).
ISR and Written Opinion for PCT/US2004/036357, Apr. 15, 2005.
Nielson et al., "Dynamic Pull-In and Switching for Sub-Pull-In Voltage Electrostatic Actuation," Proceedings of Transducers (2007).
Leus et al., "Optimizing the Dynamic Response of RF MEMS Switches using Tailored Voltage Pulses," 8th Int'l. Conf. on Thermal, Mechanical & Multiphysics Simulation and Experiments in Micro-Electronics and Micro-Systems, pp. 1-4 (2007).
Lakamraju et al., "CMOS Compatible RF MEMS switch," Proceedings of SPIE, vol. 5455, pp. 193-201 (2004).
Pakula et al., "Low Voltage, High Speed RF Switch with High Switching Capacitance Ratio," IEEE, pp. 480-483 (2005).
International Preliminary Report on Patentability and Written Opinion for PCT/US2004/036359, mailed Jul. 3, 2006.
International Preliminary Report on Patentability and Written Opinion for PCT/US2004/036357, mailed Jul. 3, 2006.

* cited by examiner

LOW-VOLTAGE MICRO-SWITCH ACTUATION TECHNIQUE

PRIORITY INFORMATION

This application claims priority to U.S. Provisional Patent Application No. 60/533,127, filed Dec. 30, 2003 which is incorporated herein by reference in its entirety.

BACKGROUND OF THE INVENTION

The invention relates to the field of micro-electro-mechanical systems (MEMS), and in particular a new actuation technique for MEMS switching that injects the energy required to actuate a switch over a number of mechanical oscillation cycles rather than just one.

In MEMS parallel plate and torsional actuators, the pull-in phenomenon has been effectively utilized as a switching mechanism for a number of applications. Pull-in is the term that describes the snapping together of a parallel plate actuator due to a bifurcation point that arises from the nonlinearities of the system. Typically the analysis of the pull-in phenomena is performed using quasi-static assumptions. However, it has been shown that under dynamic conditions, the pull-in voltage can be different from what the quasi-static analysis predicts. In a torsional switch, the pull-in voltage is found to be 8V when the voltage is slowly ramped up whereas when the voltage is applied as a step function, the pull-in voltage is only 7.3V.

Micro-electro-mechanical system (MEMS) switches based on parallel plate electrostatic actuators have demonstrated impressive performance in applications such as RF and low frequency electronic switching as well as optical switching. However, these devices have not yet become significantly commercialized. One of the reasons for this is that these switches tend to have operating voltages higher than what is normally available from an integrated circuit. Voltage up-converters are therefore necessary for these devices to operate in commercial applications which add cost, complexity, and power consumption. While some electrostatic MEMS switches have been designed for low voltage operation by decreasing the structure stiffness, this has so far only been with a significant sacrifice in reliability and performance. There are other actuation techniques, such as thermal or magnetic, that operate with lower voltages, however these are significantly slower than electrostatic switches and also consume much more power.

SUMMARY OF THE INVENTION

According to one aspect of the invention, there is provided an electro-mechanical switch structure. The switch structure includes at least one fixed electrode and a free electrode which is movable in the structure. There is a voltage potential applied between each fixed electrode and the movable electrode. The voltage potentials are modulated in such a way as to inject energy into the mechanical system until there is sufficient energy in the mechanical system to achieve actuation of the electromechanical switch structure.

According to one aspect of the invention, there is provided a method of forming an electromechanical switch structure. The method includes providing at least one fixed electrode and a free electrode that is movable in the structure. There is also provided voltage potentials applied between each fixed electrode and the free electrode. The voltage potentials are modulated in such a way as to inject energy into the mechanical system until there is sufficient energy in the mechanical system to achieve actuation of the electromechanical switch structure.

DETAILED DESCRIPTION OF THE INVENTION

The invention involves a technique that will allow the operation of MEMS switches with a significantly lower voltage without decreasing the stiffness. The actuation time will become slower but with the reduction in voltage that is potentially possible, some of this speed can be recovered by making the structure stiffer. This will have the side benefit of making the switch more reliable by reducing the chance of failure by stiction.

The technique described herein uses a modulated actuation voltage rather than the standard DC actuation voltage. This increases the complexity of the drive circuitry but allows the elimination of the off-chip voltage upconverters that would otherwise be necessary.

Figure 1A:
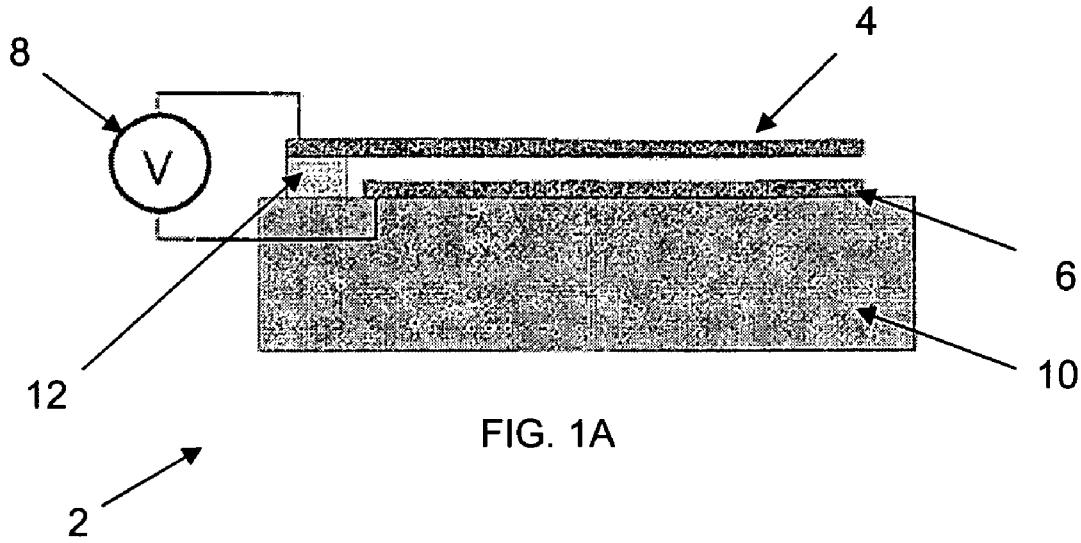
FIGS. 1A-1B are schematic diagrams of a cantilever beam implementation of a parallel plate actuator, and its corresponding lumped parameter model, respectively.

Consider the geometry shown in FIG. 1A, which illustrates a cantilever beam implementation of a parallel electrode actuator 2. The parallel electrode actuator 2 includes a free electrode 4, a fixed electrode 6, a voltage source 8 that is applied between the fixed electrode 6 and free electrode 4, and a substrate 10 where the fixed electrode is formed on. The free electrode 4 is movable along the vertical direction. An end portion of the free electrode 4 is coupled on an insulating slab 12. The insulating slab 12 permits the free electrode to be movable along the vertical axis at its end opposite to the insulating slab. A conducting material is used to form the electrodes 4, 6. The substrate 10 could be Si, but in other embodiments the substrate can be GaAs or the like without diminishing the performance of the actuator. Although it is not shown in FIG. 1A, an electrically insulating layer is required between the fixed electrode 6 and the free electrode 4. This insulating layer could be a non-conducting material such as silicon oxide or silicon nitride or could be simply a gap formed due to the geometry of the switch.

Figure 1B:
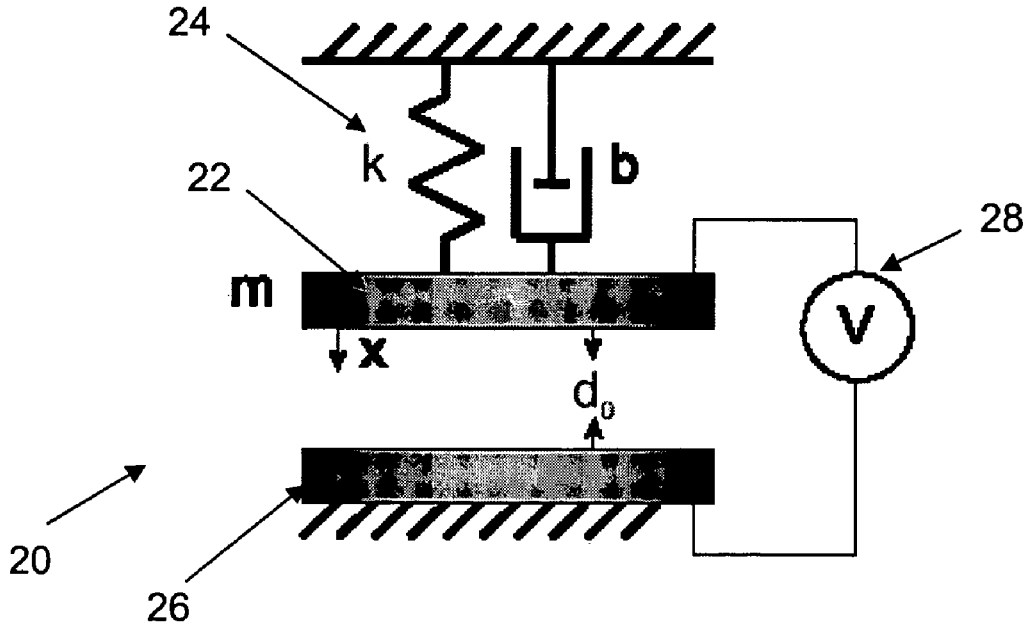

FIG. 1B shows a lumped parameter model 20 of the parallel plate actuator 2. The parallel plate actuator 2 is modeled as a free model 22 suspended by a damped spring 24 over a fixed model 26. The distance between the free model 22 and fixed electrode 26 is $d_0$. A voltage source 28 is coupled between the fixed 26 and free 22 electrodes. The direction of movement of free model 22 is defined by the x-direction. The equation of motion for this system is $$m\ddot{x} + b\dot{x} + kx = \frac{\varepsilon A V^2}{2(d_0 - x)^2}, \quad \text{EQ. 1}$$

where m is the mass of the cantilever 22, b and k the damping coefficient and stiffness of the spring 24, respectively, ∈ is the DC dielectric constant of the surrounding medium, A is the area of overlap between the fixed electrode 26 and the free electrode 22, $d_0$ is the zero-potential spacing between the two electrodes 22, 26. The dynamic variable x is the displacement of the cantilever 22 from the position do in response to the application of the potential V.

It is well known that the system 20 of FIG. 1B experiences a bifurcation when V exceeds the value $$V_{pi} = \sqrt{\frac{8kd_0^3}{27\varepsilon A}} \quad \text{EQ. 2}$$

For $V<V_{pi}$, the cantilever possesses a stable equilibrium position within $0<x<d_0$. This equilibrium position is found by assuming quasi-static conditions ($\ddot{x}\approx\dot{x}0$) with respect to EQ. 1. The stable equilibrium is then given by the root of the cubic equation $$kx_{eq} = \frac{\varepsilon A V^2}{2(d_0 - x_{eq})^2} \quad \text{EQ. 3}$$

that satisfies $0<x_{eq}<d_0/3$. When $V>V_{pi}$, there is no root to EQ. 3 in the range $[0, d_0]$. The only remaining equilibrium is $x_{eq>d0}$. Because of this property, the cantilever 22 "snaps" to the ground electrode 26; for this reason, $V_{pi}$ is referred to as the "pull-in voltage."

The pull-in calculation is usually done for the quasi-static case, as in EQ. 3. For parallel plate MEMS devices that have significant damping or if the applied voltage is slowly ramped up to the pull-in voltage (compared to the system time constant), the quasi-static analysis captures pretty well the actual pull-in voltage of the system. However, if the damping is small, the pull-in behavior of the MEMS device may be significantly affected by the dynamic response of the device to an applied voltage.

Perhaps the most common signal applied to parallel plate MEMS devices is a step voltage. For low damping, the response of the structure to a step input causes the structure to overshoot the equilibrium position. If the overshoot is large enough, pull-in could potentially occur at voltages lower than $V_{pi}$.

For the step response analysis, the applied voltage will take the form $$V(t)=V_0U(t) \quad \text{EQ. 4}$$

where U(t) is a unit step function and $V_0$ is the magnitude of the voltage.

Due to the nonlinear nature of the parallel plate model 20, finding an analytical solution for the step response of the system 20 is difficult. However, by analyzing the energy of the system 20, the important features of the system 20 response, such as overshoot and pull-in, can be identified.

Initially, the system 20 is at rest and has no stored energy. The applied voltage then injects energy into the system 20. The system 20 proceeds to store energy as both kinetic and potential energy, and also dissipates energy through damping. The energy balance of the system 20 can thus be written as follows $$E_{injected}-E_{kinetic}-E_{potential}-E_{dissipated}\approx 0. \quad \text{EQ. 5}$$

The lowest possible pull-in voltage occurs when the overshoot has its maximum value. The overshoot can be maximized by setting the damping to zero. Under this condition, no energy is lost to dissipation and, hence, the energy dissipation term in EQ. 5 can be set to zero.

When the system is at its point of maximum overshoot, all of the stored energy is in the form of potential energy. The velocity and therefore the kinetic energy are zero at that point. The stored potential energy can be expressed as $$E_{potential} = \frac{1}{2}kx_{\max}^2 \quad \text{EQ. 6}$$

where $x_{max}$ is the maximum overshoot.

The energy injected into the system 20 by the applied voltage can be found by integrating the force of the actuator over the displacement as follows $$E_{injected} = \int_0^{x_{\max}} \frac{\varepsilon A V^2}{2(d_0 - x)^2} = \frac{\varepsilon A V_0^2 x_{\max}}{2(d_0 - x_{\max})}. \quad \text{EQ. 7}$$

Combining EQs. 5, 6, and 7, and setting the kinetic and dissipated energy terms to zero, gives the following expression for the step voltage as a function of maximum overshoot $$V_0 = \sqrt{\frac{kd_0x_{\max}(d_0 - x_{\max})}{\varepsilon A}}. \quad \text{EQ. 8}$$

Taking the derivative of EQ. 8 and setting it to zero $$\left(\frac{dV_0}{dx} = 0\right)$$

gives $$x_{\max} = \frac{d_0}{2}, \quad \text{EQ. 9}$$

which is the largest maximum overshoot that can be achieved without pull-in occurring. The step voltage associated with this overshoot is analogous to the quasi-static pull-in voltage expressed in EQ. 2. Both voltages give the critical voltage above which the structure experiences pull-in. For this reason, we will refer to the step voltage associated with the overshoot expressed in EQ. 9 as the step pull-in voltage, $V_{spi}$. The step pull-in voltage is given by $$V_{spi} = \sqrt{\frac{kd_0^3}{4\varepsilon A}}. \quad \text{EQ. 10}$$

Taking the ratio between the step pull-in voltage, $V_{spi}$, and the quasi-static pull-in voltage, $V_{pi}$, gives $$\frac{V_{spi}}{V_{pi}} = \sqrt{\frac{27}{32}} \approx 0.919, \quad \text{EQ. 11}$$

which indicates that the step pull-in voltage, for the ideal case of no damping, is about 91.9% of the quasi-static pull-in voltage.

Simulations of the response of the system to a step voltage signal that include damping indicate that for moderate to low damping (Q>10), the step pull-in voltage stays relatively close to 91.9% of the quasi-static pull-in voltage. As the system damping increases, the step pull-in point follows the quasi-static equilibrium curve up until it reaches the quasi-static pull-in point, as shown in FIG. 2.

Figure 2:
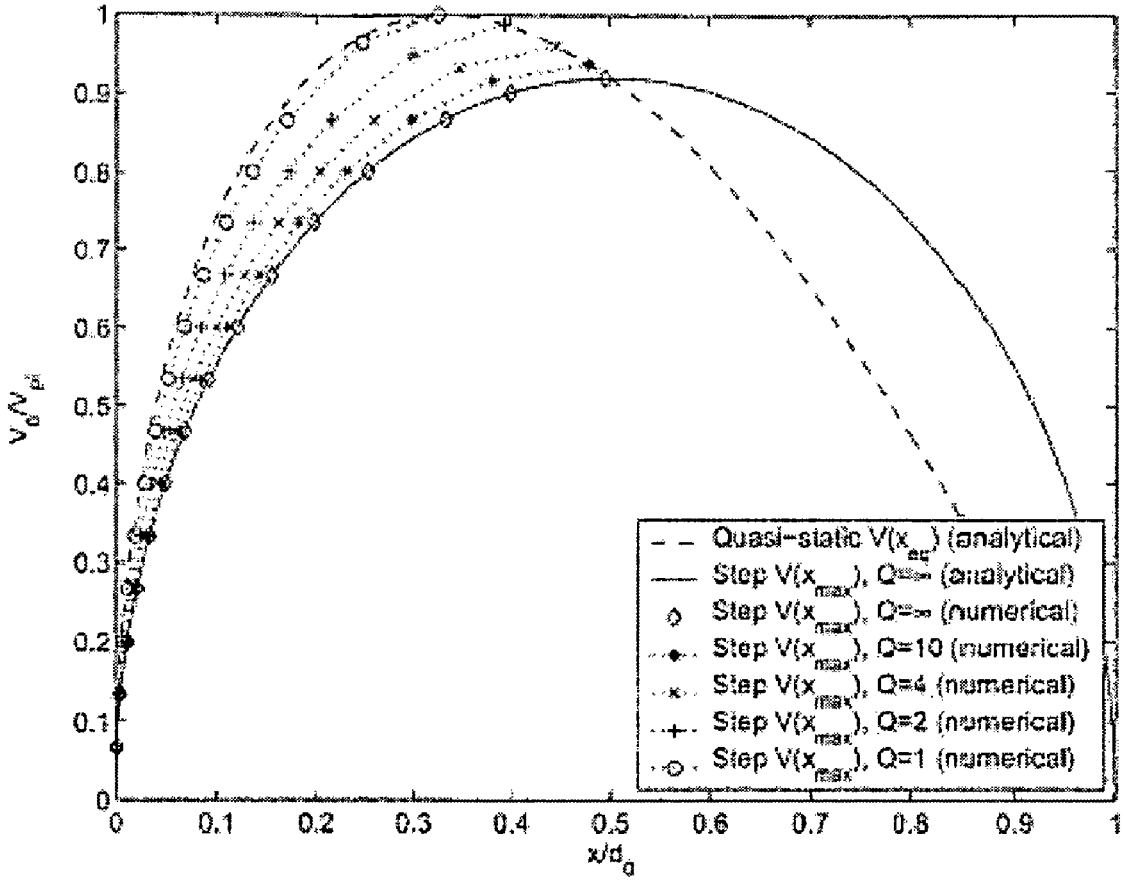
FIG. 2 is a graph illustrating the voltage for a given maximum overshoot for various levels of dampening.

In particular, FIG. 2 is a graph that demonstrates the required voltage for a given maximum overshoot for various levels of damping (Q values). As the quality factor of the system decreases, the step pull-in voltage moves from the ideal step pull-in voltage with no damping to the quasi-static pull-in voltage value.

Figure 3:
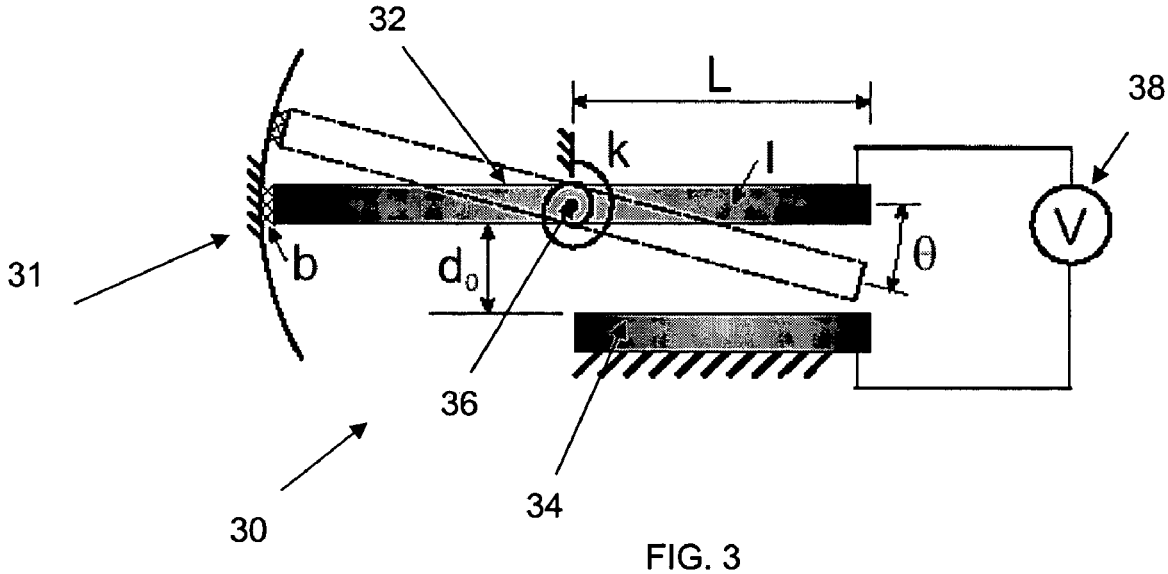
FIG. 3 is a schematic diagram illustrating a lumped parameter model of a torsional electrostatic actuator.

FIG. 3 illustrates a model 30 for a torsional electrostatic actuator. The model 30 includes a rotational plate 32, a fixed plate 34, a torsional spring 36, a torsional damper 31, and a voltage source 38. The rotational plate 32 rotates about the point where the spring 36 is attached. The energy injected into the system 30 up to the point of maximum overshoot is given by $$\int_0^{\theta_{\max}} \frac{\varepsilon w V^2}{2\theta^2}\left[\frac{L\theta}{d_0 - L\theta} + \ln\left(1 - \frac{L\theta}{d_0}\right)\right]d\theta = -\frac{1}{2}\varepsilon w V^2\left[\frac{1}{\theta_{\max}}\ln\left(1 - \frac{L\theta_{\max}}{d_0}\right) + \frac{L}{d_0}\right] \quad \text{EQ. 12}$$

where L is the length of the rotating plate from the center of rotation to the plate tip, w is the width of the rotating plate, $d_0$ is the initial separation between the plates, and θ is the rotational displacement.

The energy stored in the system at the maximum overshoot is $$\frac{1}{2}k_t\theta^2, \quad \text{EQ. 13}$$

where $k_t$ is the spring constant.

If it is assumed that no damping is in the system 30, then the energy injected will always be equal to the energy stored. This allows us to equate EQs. 12 and 13. By solving for the voltage, a relationship giving the necessary step voltage to achieve a given overshoot is found. This maximum of the EQ. 13 also indicates the step pull-in voltage for a torsional parallel plate actuator. Note the graph of the voltage for a given maximum overshoot for various levels of damping (Q values) in the torsional case is similar to the graph illustrated in FIG. 2.

Although the embodiment of the invention shown in FIG. 1 is better represented by the above discussed torsional actuator model, the invention can be embodied equally well by a parallel plate actuator, a torsional actuator or some other different embodiment whereby one of the electrodes is free to move under electrostatic actuation with respect to another, fixed, electrode. For sake of simplicity the following description will refer to the case of the parallel plate electrode, although, as shown above, very similar results can be achieved for a different actuation model.

In the case of a modulating potential in a parallel plate actuator, with the following relationship defining the potential $$V = \begin{cases} V_0 \text{ if } \dot{x} > 0 \\ 0 \text{ otherwise} \end{cases}. \quad \text{EQ. 14}$$

In this instance, energy is input into the mechanical system with each cycle. Also, for each cycle a certain amount of energy is lost due to damping. After some number of cycles, there are two possible outcomes to this situation. Either the system will reach a point where the energy input equals the energy lost per cycle, or the system will reach a pulled-in state. For now it is assumed that the system reaches a limit cycle. The energy balance at the limit cycle is $$E_{injected} = E_{dissipated}. \quad \text{EQ. 15}$$

The energy injected per cycle at the limit cycle is $$E_{injected} = \int_{-x_{\max}}^{x_{\max}} \frac{\varepsilon A V^2}{2(d_0 - x)^2} = \frac{\varepsilon A V_0^2 x_{\max}}{(d_0^2 - x_{\max}^2)}, \quad \text{EQ. 16}$$

where $x_{max}$ refers to the amplitude of the limit cycle, for the modulated signal case.

The energy dissipated is found indirectly by using the definition of the quality factor along with the stored energy in the system. The quality factor definition is $$Q = 2\pi\frac{E_{stored}}{E_{dissipated}}. \quad \text{EQ. 17}$$

By using this in the derivation, it assumes that the displacement is sinusoidal in time. Due to the nonlinearities of the system, this is not exactly true. However, for high Q values the assumption has very little effect and even for Q values as low as 10, reasonably accurate results are obtained.

The energy stored in the system is, in general, the sum of the kinetic and potential energy at any given instant. However, at the point of maximum displacement, $x_{max}$, all of the stored energy is in the form of elastic potential energy. This energy is expressed as $$E_{stored} = \frac{1}{2}kx_{\max}^2. \quad \text{EQ. 18}$$

By combining EQs. 15, 16, 17, and 18, it is possible to find a relationship for the voltage required for a given amplitude limit cycle. This relationship is $$V_0 = \sqrt{\frac{\pi k x_{\max}(d_0^2 - x_{\max}^2)}{\varepsilon A Q}}. \quad \text{EQ. 19}$$

The amplitude of the limit cycle which corresponds to the maximum voltage that leads to a limit cycle can be found by taking the derivative of EQ. 19 and setting it to $$\text{zero}\left(\frac{dV_0}{dx} = 0\right).$$

The amplitude of the maximum amplitude limit cycle is therefore $$x_{\max} = \frac{d_0}{\sqrt{3}}. \quad \text{EQ. 20}$$

The voltage associated with the limit cycle amplitude in EQ. 20 is referred to as the modulated pull-in voltage, $V_{mpi}$. For any voltage, $V_0$, above this voltage, the system will pull-in. By combining EQs. 19 and 20, the modulated pull-in voltage is found to be $$V_{mpi} = \sqrt{\frac{2\pi k d_0^3}{3\sqrt{3}\,\varepsilon A Q}}. \quad \text{EQ. 21}$$

The ratio of the modulated pull-in voltage, Vmpi to the quasi-static pull-in voltage, $V_{pi}$, is $$\frac{V_{mpi}}{V_{pi}} = \sqrt{\frac{3\sqrt{3}\,\pi}{4Q}} \approx 2.02\sqrt{\frac{1}{Q}}. \quad \text{EQ. 22}$$

Figure 4:
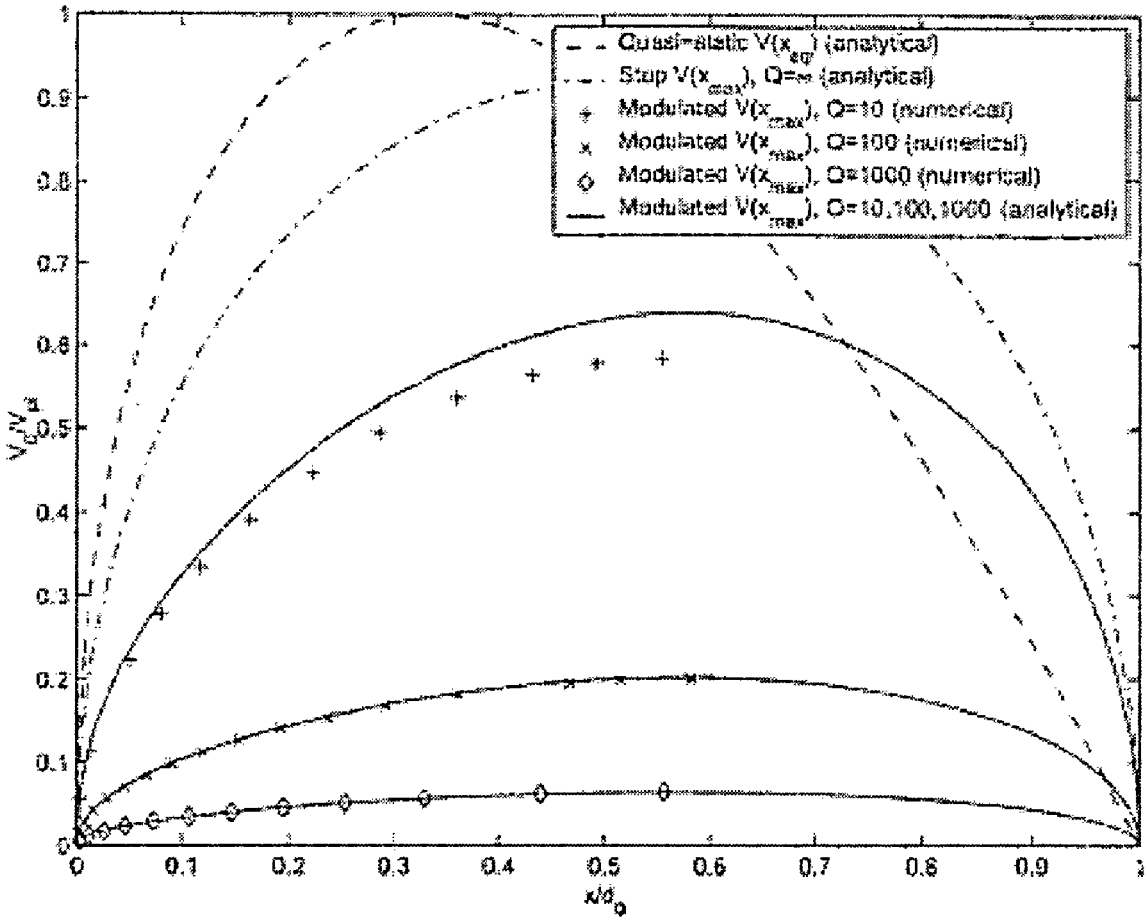
FIG. 4 is a graph comparing a parallel plate actuator's quasi-static equilibrium curve, the maximum overshoot due to a step input voltage curve, and the numerical and analytical results of the system limit cycle due to a modulated voltage input.
Figure 5:
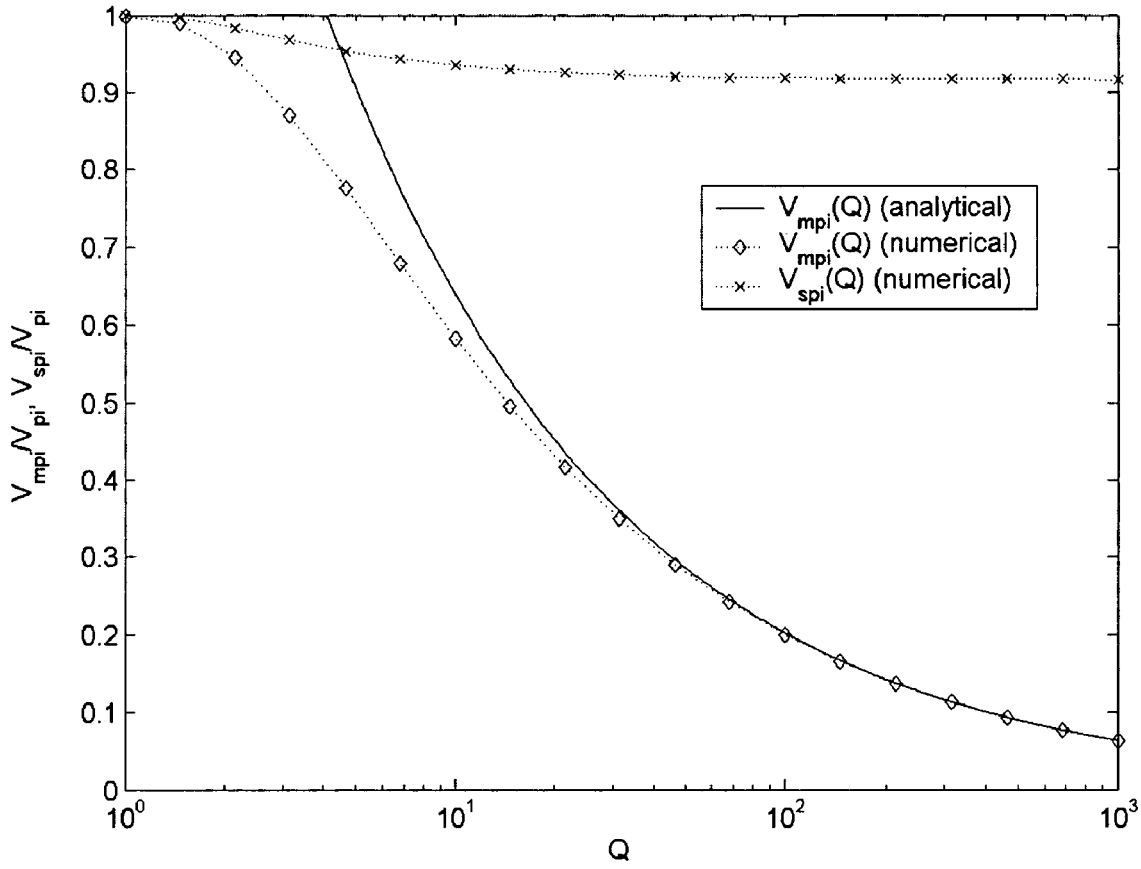
FIG. 5 is a graph of the ratio of the modulated pull-in voltage to the quasi-static pull-in voltage and the ratio of the step pull-in voltage to the quasi-static pull-in voltage as a function of the quality factor, Q, of the mechanical system.

This indicates that for a system with a quality factor of 100, the modulated pull-in voltage would be only 20% of the quasi-static pull-in voltage. This is a significant decrease in the required pull-in voltage. Systems with higher quality factors can have even lower voltages. A quality factor of 1000 would lower the required voltage to less than 7% of the quasi-static pull-in voltage. This relationship between the quality factor and the required pull-in voltage is shown in FIG. 4 and FIG. 5. Note similar results are attained for the torsional case.

Any waveform (sine, sawtooth, square, etc.) could be used to inject energy into the mechanical. In applying the waveform, the frequency of the waveform must match the resonant frequency of the MEMS structure. The MEMS resonant frequency actually varies depending on the size of the gap at a particular instant so the frequency of the applied signal needs to be altered as the mechanical oscillations increase in amplitude. Modulating the actuation signal according to EQ. 14 automatically alters the frequency of the actuation signal to match the variations in the mechanical resonant frequency. Of all waveforms, a square waveform (EQ. 14) will inject the most energy per cycle of any waveform with a given amplitude, and therefore provides actuation with the lowest possible voltage.

To achieve a modulated signal based on the state of the system, as defined in EQ. 14, a feed-back control system may be necessary. This feed-back control system would need to include a sensing mechanism to sense the state of the system. Capacitive or optical sensing are two possible methods to sense the state of the system. A possible alternative to a feed-back control system would be a open-loop system that is carefully calibrated to match the resonance frequency changes of the system during the pull-in (switching) operation.

Figure 6A:
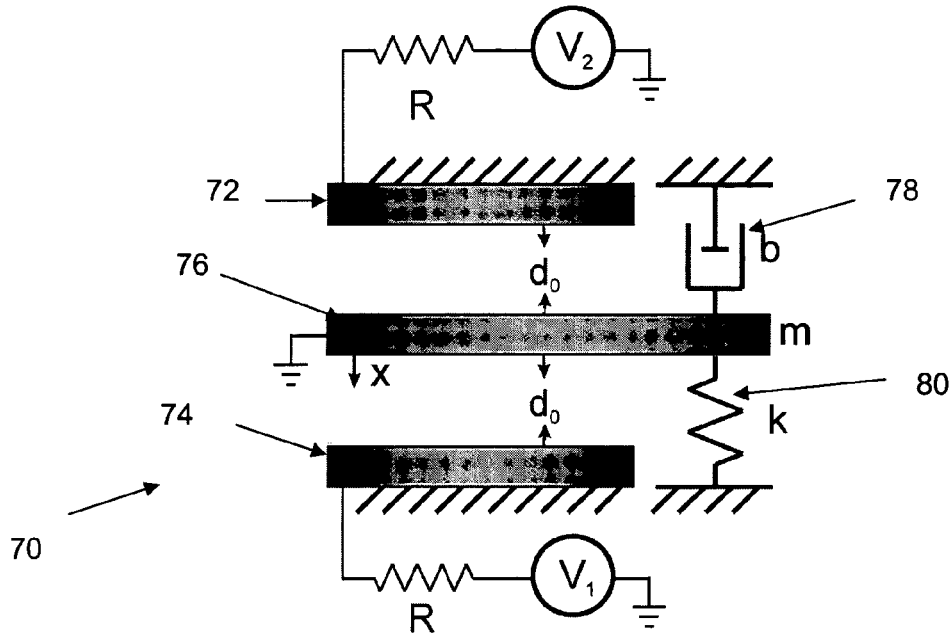
FIG. 6A-6B are schematic drawings of lumped parameter models of a parallel plate and torsional actuator, respectively, where the actuators are composed of two fixed electrodes and one movable electrode.
Figure 6B:
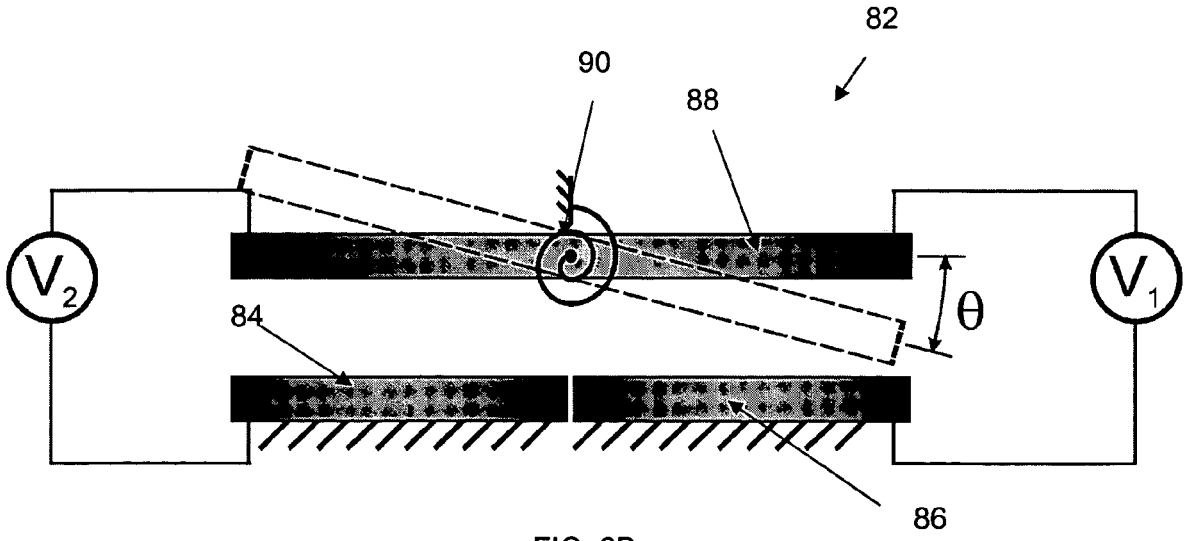

With one fixed electrode, energy is input during only half of the mechanical oscillation cycle. By including a second fixed electrode on the opposite side of the movable electrode, as shown in FIGS. 6A and 6B, energy can be injected during the entire mechanical oscillation. This is accomplished by modulating the voltage potential applied between the first fixed electrode and the free electrode according to EQ. 14 and the voltage potential applied between the second fixed electrode and the free electrode being modulated according to $$V_2 = \begin{cases} V_0 & \text{if } \dot{x} < 0 \\ 0 & \text{otherwise} \end{cases}, \quad \text{EQ. 23}$$

Using two fixed electrodes in this way allows for an even further reduction in the voltage necessary for pull-in (the additional reduction is roughly a factor of one over the square root of two for an arrangement where the fixed electrodes are symmetrically located with respect to the movable electrode).

In particular, FIG. 6A shows a model of a parallel plate actuator 70 having two fixed electrodes 72, 74 and one movable electrode 76. In addition, the model 70 includes a damper 78 and spring 80. The fixed electrodes 72, 74 are coupled to voltage sources V1 and V2. The resistors R in the electrical circuit represent the intrinsic resistance in the wires connecting the voltage sources to the electrodes.

Moreover, FIG. 6B shows a model 82 of a torsional actuator having two fixed electrodes 84, 86 and movable electrode 88. In addition, the model 82 includes a spring 90. The fixed electrodes 84, 86 are coupled to voltage sources V1 and V2, respectively.

There are a number of electrostatic MEMS switches that can benefit from this actuation technique. Some of these variations include cantilever and bridge parallel plate electrostatic actuators, torsional electrostatic MEMS switches, and horizontal "zipper" type electrostatic MEMS actuators.

The two main disadvantages to this actuation technique is that the switching time becomes longer and to get quality factors greater than about ten, the switch needs to be packaged in a vacuum package. These disadvantages are not that significant for many MEMS switching applications. For many MEMS switches, reliable operation already depends on a hermetically sealed package, which costs nearly the same as a vacuum package. The switching time can also be overcome to some extent. The significantly lower voltage requirements allow stiffer MEMS designs to be used. This leads to higher resonant frequencies which offsets to some extent the longer switching times required due to the multiple oscillations.

Because of the low damping (high Q) required for this pull-in technique, when the structure is released it will experience a long period of oscillations before it settles to its equilibrium position. To minimize this oscillation period, the inverse of the actuation rules set by EQs. 14 and 23 can be used to damp the oscillations in a much shorter time. The effect is essentially the inverse of what happens with pull-in. Instead of injecting energy into the mechanical system during each oscillation, energy is removed with each oscillation. Like the pull-in technique, this would work with both the single fixed electrode implementations as well as with the two fixed electrode implementations.

Although the present invention has been shown and described with respect to several preferred embodiments thereof, various changes, omissions and additions to the form and detail thereof, may be made therein, without departing from the spirit and scope of the invention.

What is claimed is:

1. A method of actuating an electromechanical switch structure, the method comprising:

providing at least one fixed electrode;

providing a free electrode that is movable with a voltage potential applied between each fixed electrode and the movable electrode; and using a feed-back control system to modulate the applied voltage potentials to actuate said electromechanical switch structure, wherein (i) the modulation of the applied voltage potentials is based on a state of the electromechanical switch structure, (ii) the modulation of the applied voltage potential injects energy into the electromechanical switch structure during plural oscillation cycles of said structure, (iii) a modulated pull-in voltage of said electromechanical switch structure is less than a quasi-static pull-in voltage of said structure, and (iv) the applied voltage potentials each have a waveform, and a frequency of each waveform matches a resonant frequency of the electromechanical switch structure.

2. The method of claim 1, wherein said free electrode is movable on a vertical axis.

3. The method of claim 2, wherein said at least one fixed electrode comprises a single electrode.

4. The method of claim 2, wherein said free electrode is parallel to said at least one fixed electrode.

5. The method of claim 1, wherein said free electrode rotates on an axis.

6. The method of claim 5, wherein said at least one fixed electrode comprises a single electrode.

7. The method of claim 2, wherein said at least one fixed electrode comprises two or more electrodes.

8. The method of claim 5, wherein said at least one fixed electrode comprises two or more electrodes.

9. The method of claim 1 wherein said modulated voltage potential comprises a square wave signal.

10. The method of claim 1, wherein said modulated voltage potential comprises a saw-tooth signal.

11. The method of claim 1, wherein said modulated voltage potential comprises a sine wave signal.

12. The method of claim 1, wherein the feed-back control system comprises a sensing system.

13. The method of claim 12, wherein the sensing system comprises at least one of a capacitive sensing system or an optical sensing system.

14. A method of actuating an electromechanical switch structure, the method comprising:

providing at least one fixed electrode;

providing a free electrode that is movable with a voltage potential applied between each fixed electrode and the movable electrode; and using a calibrated open-loop control system to modulate the applied voltage potentials to actuate said electromechanical switch structure, wherein the voltage signals are calibrated to match the resonant frequency changes of the structure.

15. The method of claim 14, wherein said free electrode is movable on a vertical axis.

16. The method of claim 15, wherein said at least one fixed electrode comprises a single electrode.

17. The method of claim 15, wherein said free electrode is parallel to said at least one fixed electrode.

18. The method of claim 14, wherein said modulated voltage signal comprises a square wave signal.

19. The method of claim 14, wherein said modulated voltage signal comprises a saw-tooth signal.

20. The method of claim 14, wherein said modulated voltage signal comprises a sine wave signal.

* * * * *